US007051769B2

(12) United States Patent
Berktold

(10) Patent No.: US 7,051,769 B2
(45) Date of Patent: May 30, 2006

(54) WEAVING MACHINE FOR THE MANUFACTURE OF LENO CLOTHS

(75) Inventor: Klaus Berktold, Rueti (CH)

(73) Assignee: Sultex AG, Rueti (CH)

( * ) Notice: Subject to any disclaimer, the term of this patent is extended or adjusted under 35 U.S.C. 154(b) by 183 days.

(21) Appl. No.: 10/674,574

(22) Filed: Sep. 29, 2003

(65) Prior Publication Data

US 2004/0065379 A1 Apr. 8, 2004

(30) Foreign Application Priority Data

Oct. 4, 2002 (EP) ..... 02405859

(51) Int. Cl.
*D01H 11/00* (2006.01)

(52) U.S. Cl. ..... 139/1 C; 139/50

(58) Field of Classification Search ..... 15/300.1, 15/301, 316.1, 345–346; 139/1 C, 1 R, 50
See application file for complete search history.

(56) References Cited

U.S. PATENT DOCUMENTS

| | | | | |
|---|---|---|---|---|
| 4,678,012 A | | 7/1987 | Graham et al. | |
| 5,524,676 A | * | 6/1996 | Scorl et al. | 139/1 C |
| 5,910,598 A | | 6/1999 | Shofner et al. | |
| 6,006,790 A | * | 12/1999 | Cooper | 139/1 C |

FOREIGN PATENT DOCUMENTS

| | | |
|---|---|---|
| DE | 1679571 A | 4/1971 |
| DE | 1710296 A | 10/1971 |
| DE | 2755449 A1 | 5/1979 |
| DE | 10057692 A1 | 5/2002 |
| EP | 0596571 A1 | 5/1994 |

* cited by examiner

*Primary Examiner*—John J Calvert
*Assistant Examiner*—Andrew W. Sutton
(74) *Attorney, Agent, or Firm*—Townsend and Townsend and Crew LLP

(57) ABSTRACT

A weaving machine for the manufacture of leno cloths includes a leno apparatus with leno elements (5, 5', 7, 7', 8, 8') for the forming of a shed (6) as well as additionally a cleaning apparatus with a plurality of nozzles (10.1, 10.2, 11, 13) for the removal of contaminations in the region of the leno apparatus and of the shed (6). Two of the nozzles (10.1, 10.2) are arranged above the shed, by means of which a compressed air flow (16.1–16.4) which is directed downwardly through the shed (6) from above is produced, and one of the nozzles (11) is arranged in the lower region of the leno elements, by means of which a compressed air flow (17) which is directed substantially horizontally towards the leno elements (5, 5', 7, 7', 8, 8') is produced. In addition, a suction nozzle (13) by means of which a downwardly directed suction air flow (19) is produced is arranged beneath the shed.

10 Claims, 6 Drawing Sheets

WEAVING MACHINE FOR THE MANUFACTURE OF LENO CLOTHS

BACKGROUND OF THE INVENTION

The invention relates to a weaving machine for the manufacture of leno cloths and to a method for cleaning a weaving machine.

Newer generations of weaving machines for the manufacture of leno cloths, in particular of leno cloths which serve as base fabrics for the manufacture of carpets, are being operated at increasing speeds of rotation. The increase in the speeds of rotation became possible above all through the use of airjet weft insertion systems, through which it was possible to achieve a considerable increase in performance. With this increase in performance the contamination through fiber fly also increased. In dependence on the kind of warp thread material, accumulations of fiber fly are formed in the region of the leno apparatus, more precisely at the elements of the leno apparatus, e.g. at needle bars, deflection elements or insertion rails. The fiber fly formation is particularly extreme when using fiber yarns, such as for example cotton.

In a weaving machine for the manufacture of cloths with simple warp thread systems, such as for example cloths with canvas binding and their derivatives, the warp threads cross one another at each new for-ming of a shed; i.e. the lower warp threads come to lie upwardly and the upper ones downwardly. Through this crossing of warp threads in the forming of a shed, large accumulations of fiber fly in the shed are largely avoided.

In the manufacture of leno cloths, in particular of semi-leno cloths, which serve as base fabrics for the manufacture of carpets, the same warp threads always lie upwardly or downwardly respectively in the shed. The ground threads and the leno threads are lifted with respect to one another after a weft insertion only to such an extent as is required for the change of side of the leno threads. The fiber fly can thus accumulate without hindrance at the elements of the leno apparatus. This is especially true of the rear region of the shed. Larger accumulations which come loose from the elements of the leno apparatus are also enclosed in the region of the shed between the ground and leno threads and can be removed from there only with difficulty.

To avoid blockages in the thread passages of the leno apparatus, as well as the thread breakages and the corresponding longer standstill times of the weaving machine resulting therefrom, the newer weaving machines for the manufacture of leno cloths must be stopped as a precautionary measure for the purpose of removing fiber fly accumulations. This is time-consuming and reduces the weaving performance. So-called travelling clearers, such as are known from the prior art, produce only an insufficient cleaning effect in the critical regions of the leno apparatus.

SUMMARY OF THE INVENTION

An object of the present invention is to make available a weaving machine for the manufacture of leno cloths which need not be stopped for cleaning the leno apparatus and the shed. A further object of the invention is to make available a method for cleaning a weaving machine for the manufacture of leno cloths by means of which contaminations of the leno apparatus and of the shed can be effectively removed.

The weaving machine in accordance with the invention for the manufacture of leno cloths includes a leno apparatus with leno elements for the forming of a shed. The weaving machine additionally includes a cleaning apparatus which is integrated into the weaving machine for the removal of contaminations in the region of the leno apparatus and/or of the shed.

In a preferred embodiment the weaving machine is equipped in a known manner with a reed, and the leno elements comprise guide elements and a deflection element for ground threads as well as leno thread guide elements. In the preferred embodiment the integrated cleaning apparatus includes one or more nozzles, by means of which a substantially horizontal compressed air flow which is transverse to the direction of travel of the ground and leno threads can be produced in the region between the ground and leno threads, in particular in the rear part of the shed. In a further preferred embodiment the integrated cleaning apparatus includes at least one nozzle which is arranged between the reed and the leno thread guide elements and by means of which a compressed air flow or suction air flow can be produced which is directed downwardly through the shed from above. In a further preferred embodiment the integrated cleaning apparatus includes at least one nozzle which is arranged in the lower region of the leno elements and by means of which a compressed air flow or suction air flow directed towards the leno elements can be produced.

In one variant the cleaning apparatus includes two nozzles which are fed with compressed air, which are arranged between the reed and the leno thread guide elements and which are directed towards the shed from above, with one of the two nozzles being arranged between the reed and the ground thread guide elements and the other nozzle being arranged between the ground thread and leno thread guide elements. In a further variant the cleaning apparatus includes at least two nozzles, of which one nozzle has a substantially horizontal jet direction and one nozzle has a substantially vertical jet direction.

The integrated cleaning apparatus preferably includes at least one nozzle which is arranged to be movable in the longitudinal direction of the reed. The integrated cleaning apparatus preferably includes at least one nozzle which is designed as a stationarily arranged slit nozzle with a horizontal slit arrangement. The integrated cleaning apparatus preferably includes one or more stationarily mounted suction nozzles and/or a suction passage which are or is arranged beneath the shed transverse to the direction of travel of the ground and leno threads.

The deflection element in the leno apparatus of the weaving machine is preferably acted on by compressed air and includes nozzles by means of which a substantially horizontal compressed air flow transverse to the direction of travel of the ground and leno threads can be produced in the region between the ground and leno threads.

In a further preferred embodiment the weaving machine includes a control system in order to control the operation of the compressed air and/or suction nozzles of the integrated cleaning apparatus and in order to activate the nozzles of the integrated cleaning apparatus. The control system preferably makes it possible to activate the nozzles periodically and/or cyclically and/or one after the other and/or when required.

It is preferably possible for the weaving machine to be used in a weaving mill, said weaving mill being equipped with one or more travelling clearers, with the named control system being suitable for activating the integrated cleaning apparatus of the weaving machine in accord with, i.e. in coordination with, the travelling clearers.

The method in accordance with the invention for the cleaning of a weaving machine for the manufacture of leno cloths, the weaving machine including a leno apparatus with leno elements for the forming of a shed, is characterized in that contaminations in the region of the leno apparatus and/or of the shed are removed by means of a cleaning apparatus which is integrated into the weaving machine.

In a preferred embodiment of the method the integrated cleaning apparatus of the weaving machine is activated via a control system in the weaving machine. The weaving machine is preferably used in a weaving mill, the weaving mill being equipped with one or more travelling clearers, with the integrated cleaning apparatus of the weaving machine being activated in accord with the travelling clearers. The contaminations which are forwarded out of the shed by means of the internal cleaning apparatus are preferably removed through travelling clearers.

In a further preferred embodiment of the method the shed is formed in a known manner from ground and leno threads. In addition, the integrated cleaning apparatus includes a plurality of nozzles by means of which a substantially horizontal compressed air flow transverse to the direction of travel of the ground and leno threads is produced in the region between the ground and leno threads, in particular in the rear part of the shed. The nozzles are preferably charged with compressed air periodically and/or cyclically and/or one after the other and/or when required. The named nozzles preferably cooperate with at least one substantially vertically oriented nozzle and/or at least one nozzle which is oriented substantially horizontally and opposite to the direction of travel of the ground and leno threads.

By means of the cleaning apparatus which is integrated into the weaving machine in accordance with the invention and in particular by means of the described nozzle arrangement, contaminations in the region of the leno apparatus and of the shed can be effectively removed. An advantageous cleaning action results when nozzles with a different arrangement and/or with a different orientation of the compressed air flows and/or suction flows are combined, for example one or more nozzles with substantially vertically directed compressed air flows and/or suction flows with one or more nozzles with substantially horizontally directed compressed air flows and/or suction flows. Particularly advantageous is a nozzle arrangement by means of which a substantially horizontal compressed air flow transverse to the direction of travel of the ground and leno threads can be produced between the ground and leno threads and by means of which contaminations, in particular also fiber fly accumulations which are enclosed in the region of the shed between the ground and leno threads, can be removed.

In the following the invention will be explained in more detail with reference to the exemplary embodiments and with reference to the drawings.

DESCRIPTION OF THE PREFERRED EMBODIMENTS

In some publications on the manufacture of leno cloths the designations "ground thread" and "leno thread" are reversed with respect to the following description. The choice of the terminology has no influence on the design and functioning of the described apparatus however.

Figure 1:
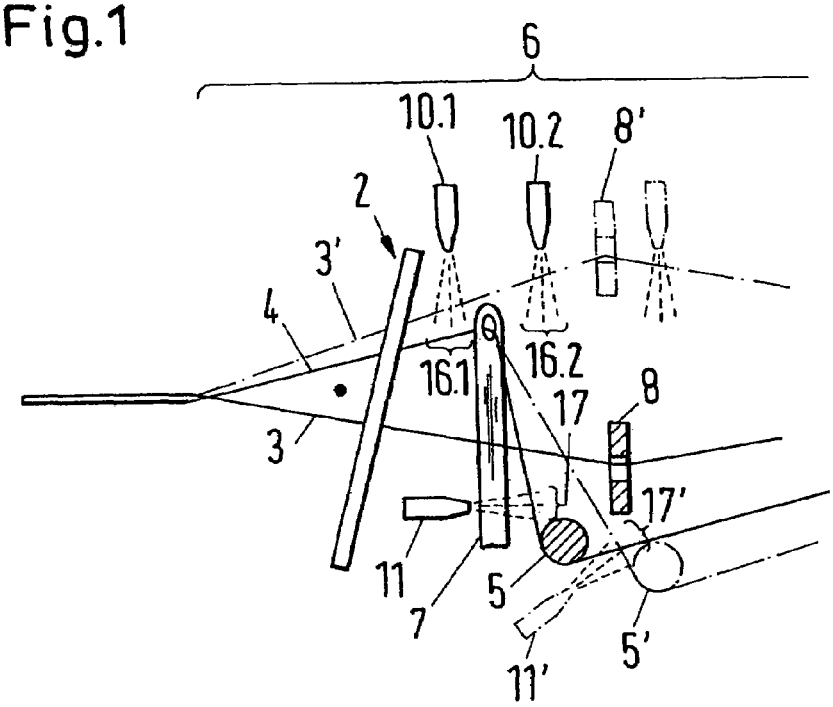
FIG. 1 shows a first exemplary embodiment pertaining to the present invention.

FIG. 1 shows a first exemplary embodiment of a weaving machine for the manufacture of leno cloths in accordance with the present invention. The weaving machine includes in a known manner a leno apparatus and a reed 2 for beating up the inserted weft thread. The leno apparatus includes guide elements 7 and a deflection element 5, 5' for ground threads 4 as well as leno thread guide elements 8, 8' for forming a shed 6 and for producing the leno binding. In the following the shed 6 includes not only the front shed which lies between the reed 2 and the beat up edge, but rather the entire region between the ground and leno threads 3, 3', 4, which is enclosed by the ground and leno threads, which are raised and/or lowered to different levels. The ground thread guide elements 7 in the exemplary embodiment are designed as a needle bar with ground lamella which are provided at the free end with eyes. The leno thread guide elements 8, 8' are designed as an insertion rail. In place of the insertion rail, a second needle bar with fixed or movable leno lamella and/or heald frames can also be used to guide the leno threads 3, 3'.

In addition the weaving machine also includes a cleaning apparatus with a plurality of nozzles 10.1, 10.2, 11, 11' which is integrated into the weaving machine. In the first exemplary embodiment two nozzles 10.1, 10.2 which are fed with compressed air and which are directed towards the shed 6 from above are arranged between the reed 2 and the leno thread guide elements 8, 8', with one of the two nozzles 10.1 being arranged between the reed 2 and the ground thread guide elements 7 and the other nozzle 10.2 being arranged between the ground thread guide element 7 and the leno thread guide elements 8, 8'. A compressed air flow 16.1, 16.2 which is directed downwards through the shed 6 from above can be produced by means of the two nozzles 10.1, 10.2. A further nozzle 11 is arranged in the lower region of the ground thread guide elements 7, by means of which a compressed air flow 17 which is directed towards the ground thread guide elements 7 and/or the deflection element 5 can be produced. The compressed air flow 17 is preferably horizontally directed. In a variant the deflection element 5' is arranged offset from the ground thread guide elements 7. By means of an additional nozzle 11' which is provided in the region of the offset deflection element 5', a compressed air flow 17' can be produced which is directed towards the deflection element.

Figure 2:
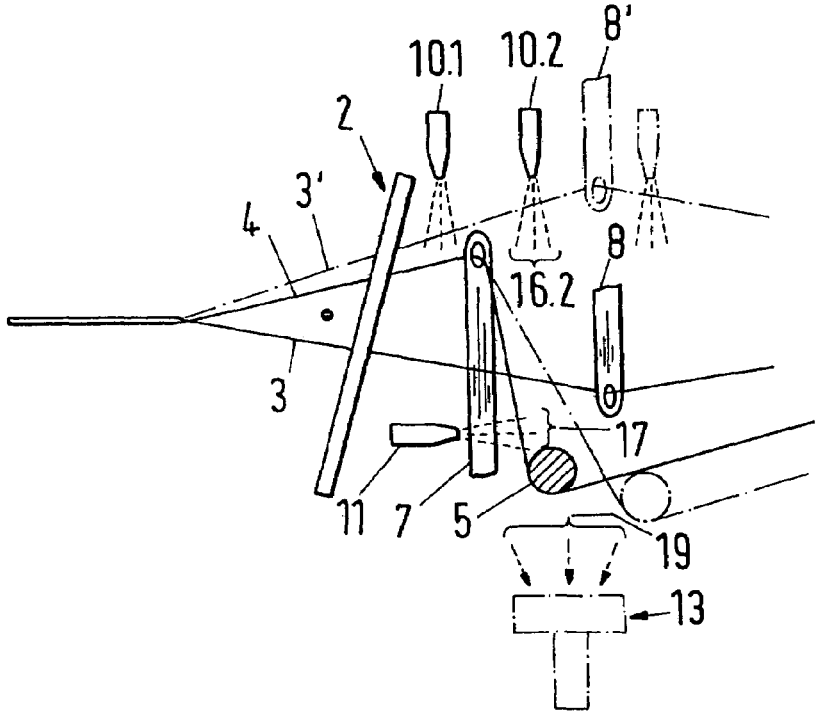
FIG. 2 shows a variant with an additional suction nozzle and with leno thread guidance differing from that of FIG. 1.

In an advantageous variant, which is shown in FIG. 2, the integrated cleaning apparatus includes a suction nozzle 13 which is arranged beneath the shed 6 and preferably in the region of the deflection element 5. A suction air flow 19 which is directed downwardly through the shed 6 from above can be produced by means of the suction nozzle 13.

In the variant shown, the air flow 19 assists the cleaning action of the compressed air flows 16.1, 16.2 which act from above and serves to remove the blown away fiber fly from the machine. In place of an individual suction nozzle 13, a row of suction nozzles 13 and/or a suction passage arranged horizontally and transverse to the direction of travel of the ground and leno threads 3, 3', 4 can advantageously be provided.

Figure 5:
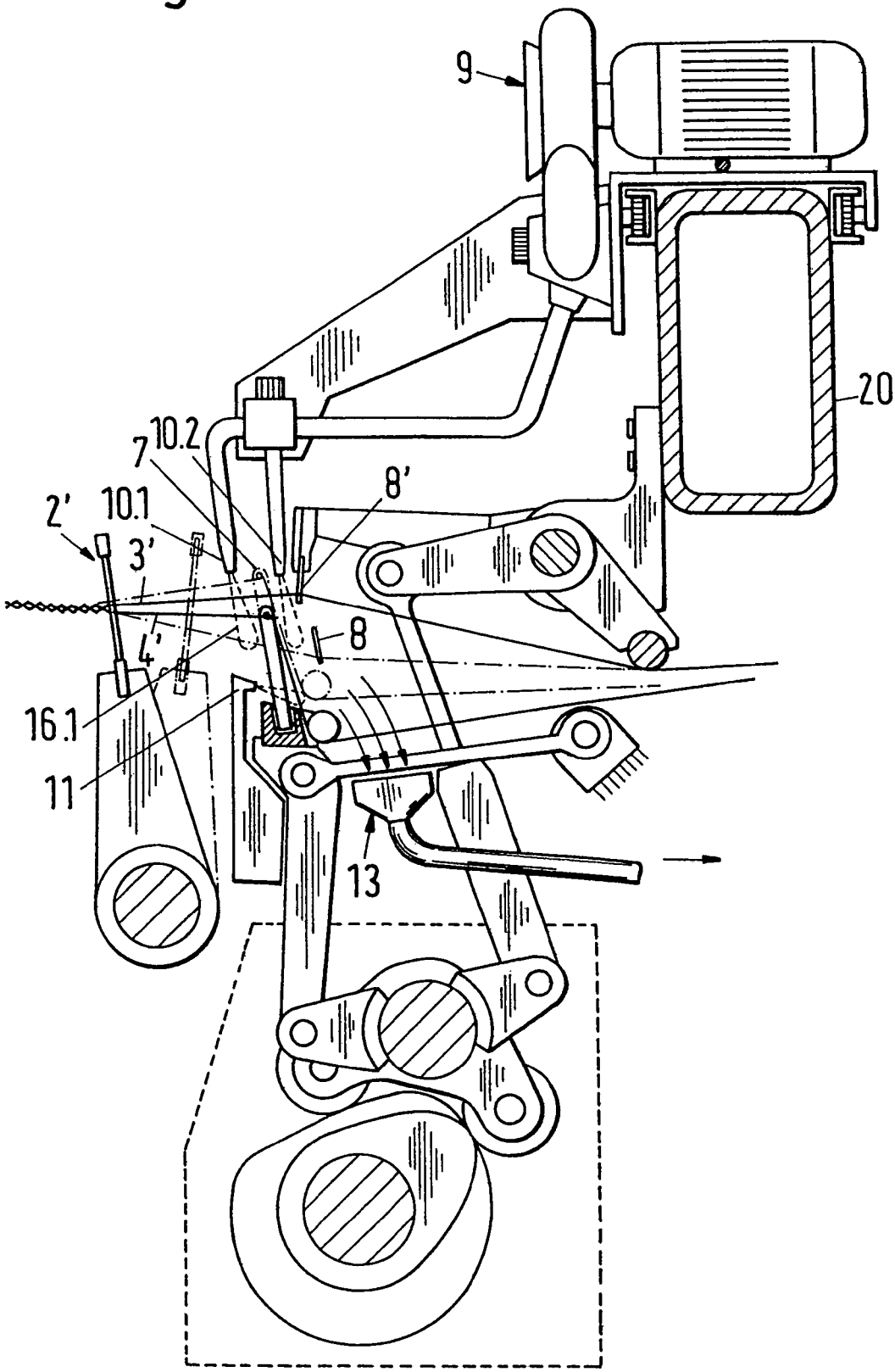
FIG. 5 shows a variant pertaining to the first exemplary embodiment with compressed air nozzles which can be displaced in the longitudinal direction of the reed.

In a further variant pertaining to the first exemplary embodiment, which is shown in FIG. 5, the integrated cleaning apparatus includes a compressed air blower 9, which supplies the nozzles 10.1, 10.2, which are directed from above towards the shed 6, with compressed air. The compressed air blower 9 is movably mounted together with the nozzles 10.1, 10.2 on a cross beam 20, so that the nozzles can be displaced parallel to the longitudinal direction of the reed 2, 2'. The displaceable arrangement of the nozzles enables a cleaning over the entire weaving width. The nozzle 11, which is arranged in the lower region of the ground thread guide elements 7 and by means of which a compressed air flow 17 directed towards the ground thread guide elements 7 and/or the deflection element 5 can be produced, is designed as a stationarily arranged slit nozzle with a horizontal slit arrangement. Alternatively, a nozzle 11 which is movable in the longitudinal direction of the reed 2, 2' can be provided at this location.

Figure 6:
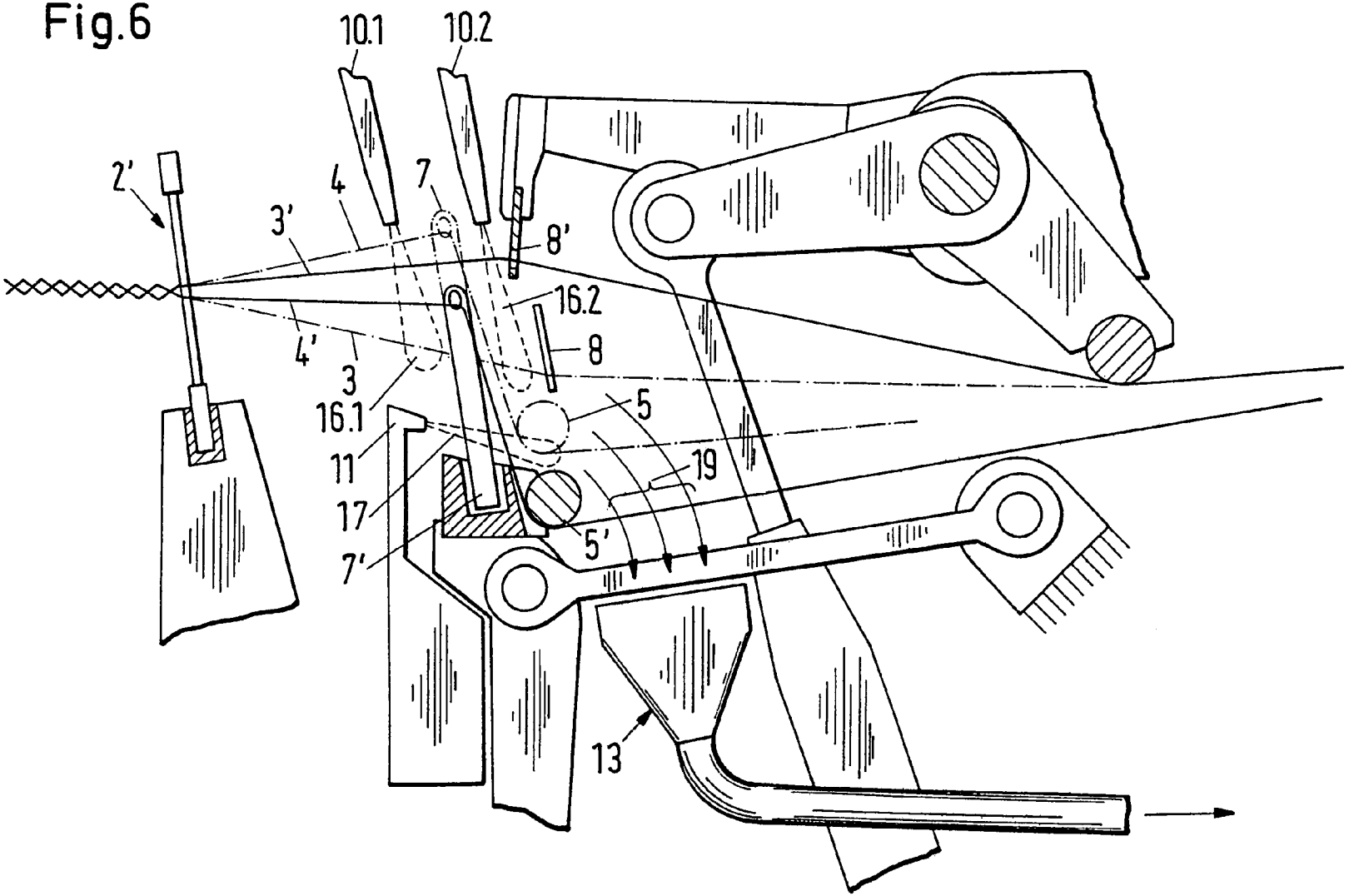
FIG. 6 shows an enlarged section of the nozzle arrangement pertaining to the variant shown in FIG. 5.

FIG. 6 shows an enlarged section of the nozzle arrangement pertaining to the variant which is shown in FIG. 5. The reed is shown in FIG. 6 in the beat up position. Likewise illustrated is the position of the ground thread guide elements 7', of the deflection element 5' and of the leno thread guide elements 8' as well as the position 3', 4' of the ground and leno threads when the reed is in the beat up position.

Figure 3:
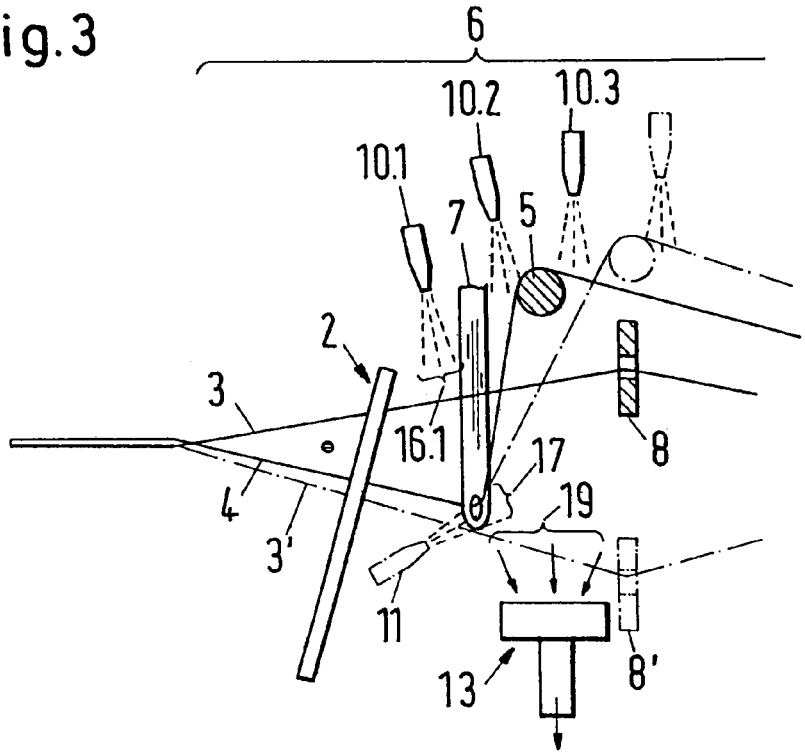
FIG. 3 shows a second exemplary embodiment pertaining to the present invention with an upwardly disposed attachment of the ground thread guide element.

In a second exemplary embodiment pertaining to the present invention, which is shown in FIG. 3, the orientation of the ground thread guide elements 7 is inverted with respect to the first exemplary embodiment; i.e. the attachment of the ground thread guide elements is now disposed at the top and the eyes of the ground needles are now arranged at the lower end. In the second exemplary embodiment the integrated cleaning apparatus includes three nozzles 10.1–10.3 which are fed with compressed air, which are arranged between the reed 2 and the leno thread guide elements 8, 8' and which are directed from above towards the shed 6, with one of the three nozzles 10.1 being arranged between the reed 2 and the ground thread guide elements 7 and one each of the nozzles 10.2, 10.3 being arranged ahead of and behind the deflection element 5 respectively. A compressed air flow 16.1 which is directed downwardly through the shed 6 from above can be produced by means of the three nozzles 10.1–10.3. A further nozzle 11 is arranged in the lower region of the ground thread guide elements 7, by means of which a compressed air flow 17 directed towards the eyes of the ground thread guide elements 7 can be produced.

Furthermore, in the second exemplary embodiment the integrated cleaning apparatus is provided with a suction nozzle 13 which is arranged beneath the shed 6 and preferably between the ground thread guide elements 7 and leno thread guide elements 8, 8'. An air flow 19 which is downwardly directed through the shed 6 from above can be produced by means of the suction nozzle 13. In the second exemplary embodiment the suction air flow 19 assists the cleaning action of the compressed air flow 16.1 which acts from above and serves to remove the blown away fiber fly from the weaving machine. A row of suction nozzles 13 and/or a suction passage arranged horizontally and transverse to the direction of travel of the ground and leno threads 3, 3', 4 can advantageously be provided in place of an individual suction nozzle 13.

Figure 4:
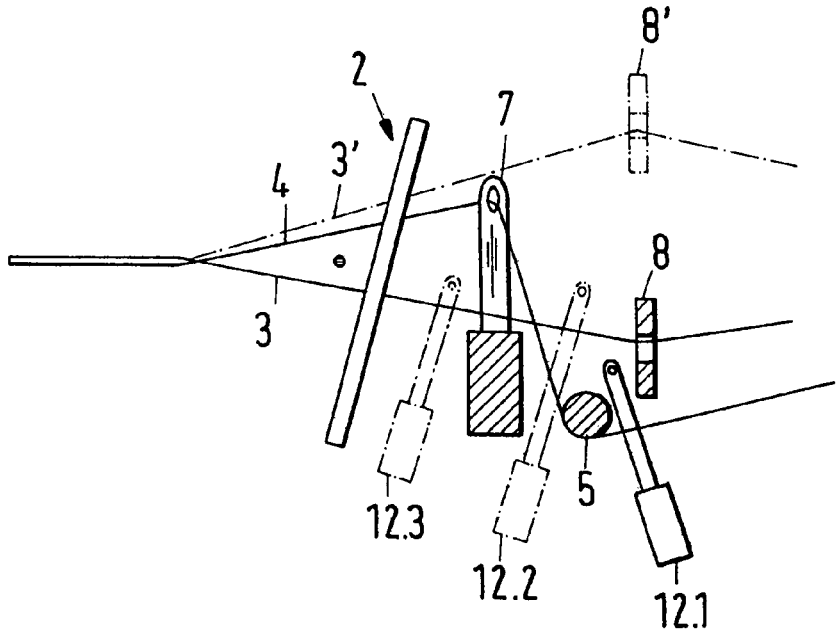
FIG. 4 shows a third exemplary embodiment pertaining to the present invention.

FIG. 4 shows a third exemplary embodiment pertaining to the present invention, in which the integrated cleaning apparatus includes one or more nozzles 12.1 which are arranged ahead of the ground thread guide elements 7 when viewed in the direction of travel of the ground and leno threads 3, 3' and 4. The nozzles 12.1 are arranged in such a manner that a substantially horizontal compressed air flow which is transverse to the direction of travel of the ground and leno threads can be produced between the ground and leno threads by means of the nozzles. The nozzles 12.1 are preferably arranged in a row between the ground and leno threads. In one variant the nozzles 12.1 are designed as relay nozzles, with it being possible for the nozzles to be charged with compressed air cyclically in the sense of a wandering field. By means of the nozzle or nozzles 12.1, fiber fly accumulations, in particular also larger accumulations, which are enclosed in the region of the shed between the ground and leno threads can be blown out to the selvedge and removed. FIG. 4 also shows two variants with a second arrangement 12.2 and a third arrangement 12.3 of the nozzles, by means of which a substantially horizontal compressed air flow transverse to the direction of travel of the ground and leno threads can be produced. In the second arrangement 12.2 the nozzles are arranged ahead of the ground thread guide elements 7 when viewed in the direction of travel of the ground and leno threads 3, 3', 4, as in the basic variant of the third exemplary embodiment, and in the third arrangement 12.3 the nozzles are arranged between the reed 2 and the ground thread guide elements 7.

Figure 7A:
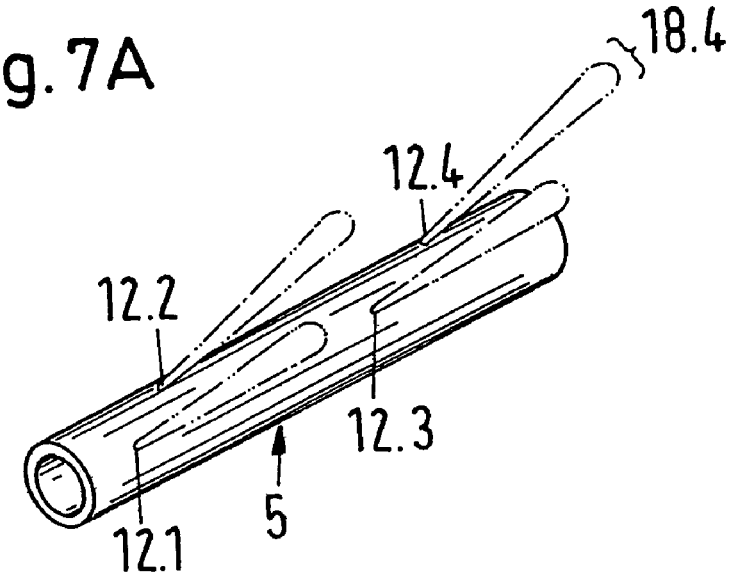
FIG. 7A shows a variant of a deflection element which is acted on by compressed air.
Figure 7B:
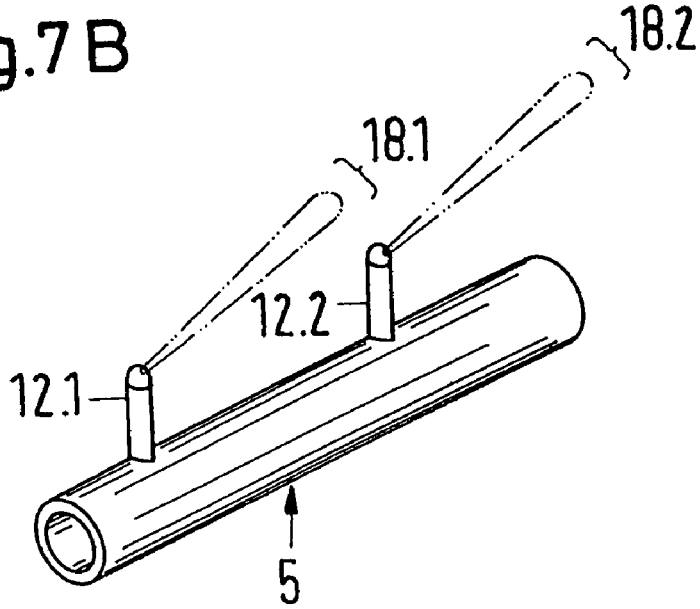
FIG. 7B shows a further variant of a deflection element which is acted on by compressed air.

In two further advantageous variants, which are illustrated in FIGS. 7A and 7B, the deflection element 5 of the leno apparatus is formed as a part of the integrated cleaning apparatus. For this purpose the deflection element 5 is charged with compressed air and includes nozzles 12.1–12.4 for the removal of fiber fly from the surroundings of the deflection element and from the shed 6. In the variant which is shown in FIG. 7A the nozzle openings of the nozzles 12.1–12.4 are let directly into the deflection element, whereas in the variant which is shown in FIG. 7B, the nozzle openings of the nozzles 12.1, 12.2 are arranged to be spaced from the deflection element 5. The deflection element 5 also expediently includes nozzles 12.1–12.4 by means of which a substantially horizontal compressed air flow transverse to the direction of travel of the ground and leno threads can be produced between the ground and leno threads (3, 3', 4, 4').

In a preferred embodiment the weaving machine includes in accordance with one of the above-described exemplary embodiments a control system in order to control the operation of the compressed air or suction nozzles of the integrated cleaning apparatus, for example in that the nozzles are activated periodically and/or cyclically and/or one after the other and/or when required. This enables an economically ideal operation of the cleaning apparatus.

Figure 8:
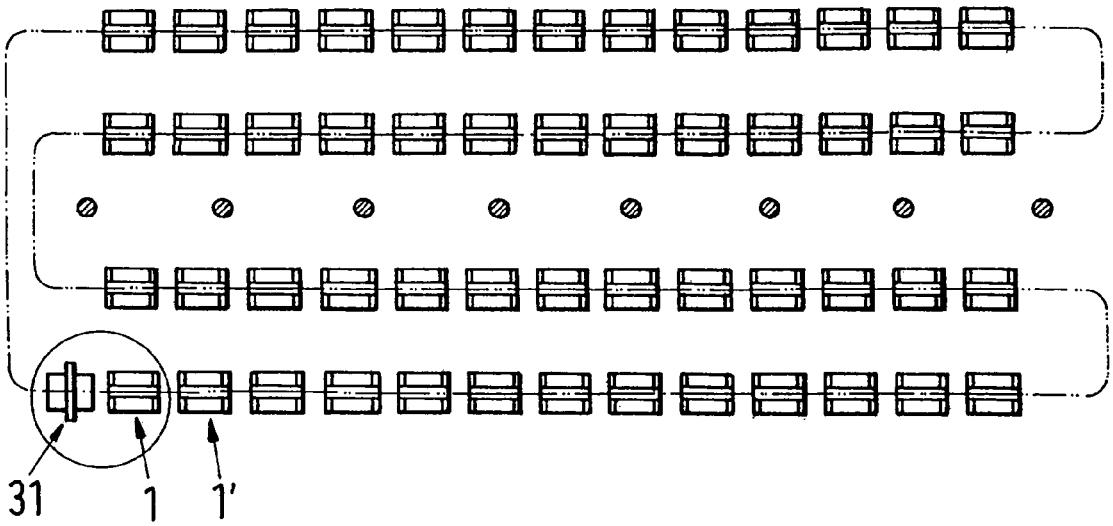
FIG. 8 is a plan view of a weaving mill with weaving machines and travelling clearers.

FIG. 8 shows a plan view of a weaving mill with a large number of weaving machines 1, 1' and a travelling clearer 31. The travelling clearer 31 is displaceably mounted on a guide, with the guide being designed in such a manner that the travelling clearer is guided over all weaving machines during the displacement. The weaving machine 1, 1' is preferably equipped with an integrated cleaning apparatus in accordance with one of the above-described exemplary embodiments and with a control system which is suitable for activating the integrated cleaning apparatus in accord with the travelling clearer 31.

Figure 9:
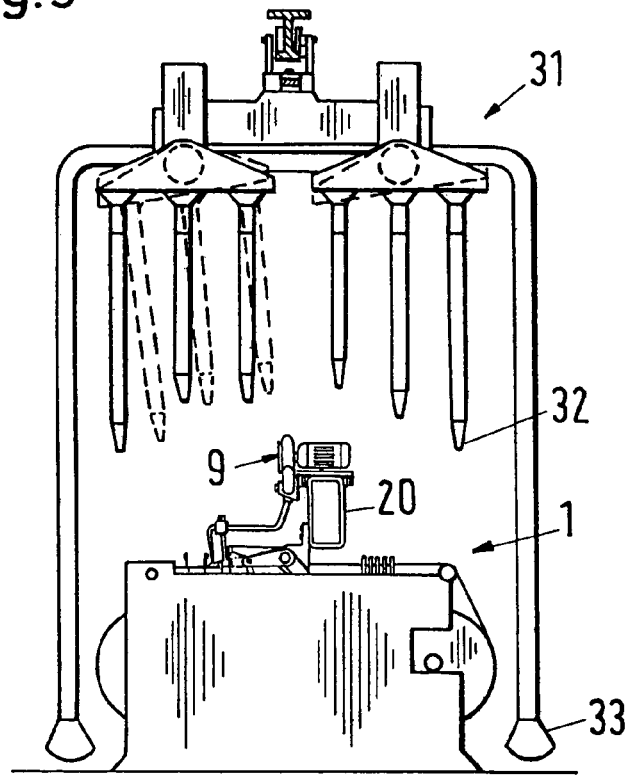
FIG. 9 shows a detail view of FIG. 8 with a weaving machine and travelling clearer as seen from the side.

FIG. 9 shows a side view of a weaving machine 1 and of a travelling clearer 31. The weaving machine is equipped with an internal cleaning apparatus which includes a blower 9 which is displaceably arranged on a cross beam 20 of the weaving machine. The travelling clearer includes compressed air nozzles 32 which are directed towards the weaving machine from above and suction nozzles 33 which are arranged just above the base in order to take up the contaminations which are blown away by the compressed air nozzles 32. The internal cleaning apparatus of the weaving machine 1 is advantageously activated when the travelling clearer 31 approaches the weaving machine.

A first exemplary embodiment of a method in accordance with the invention for cleaning a weaving machine for the manufacture of leno cloths will be described in the following with reference to FIGS. 1, 2 and 4. The weaving machine includes in a known manner a leno apparatus with leno elements 5, 7, 8, 8' for forming a shed 6. The method is distinguished in that contaminations in the region of the leno apparatus and/or of the shed are removed by means of a cleaning apparatus which is integrated into the weaving machine.

In a preferred embodiment of the method the shed 6 is formed in a known manner by ground threads 4, 4' and leno threads 3, 3'. In addition the integrated cleaning apparatus includes a plurality of nozzles 12.1, by means of which a substantially horizontal compressed air flow transverse to the direction of travel of the ground and leno threads is produced in the region between the ground and leno threads, in particular in the rear part of the shed. In one variant the nozzles are charged with compressed air periodically and/or cyclically and/or one after the other and/or when required. In a further variant the named nozzles cooperate with at least one substantially vertically oriented nozzle or with at least one nozzle which is oriented substantially horizontally opposite to the direction of travel of the ground and leno threads.

In a further preferred embodiment of the method the integrated cleaning apparatus of the weaving machine is controlled and/or activated via a control system in the weaving machine. In a variant which will be explained in more detail in the following with reference to FIGS. 8 and 9 the weaving machine 1, 1' is used in a weaving mill, said weaving mill being equipped with one or more travelling clearers 31, with the integrated cleaning apparatus of the weaving machine being activated in coordination with the travelling clearers 31. The contaminations which are forwarded out of the shed of the weaving machine 1, 1' by means of the integrated cleaning apparatus are preferably removed through the travelling clearers 31.

The invention claimed is:

1. Weaving machine for the manufacture of leno cloths comprising a reed and a leno apparatus with leno elements for the forming of a shed including guide elements and a deflection element for ground threads and leno thread guide elements for leno threads, and a cleaning apparatus integrated into the weaving machine for the removal of contaminations in the region of the leno apparatus including one or more nozzles arranged to produce a substantially horizontal compressed air flow transverse to a direction of travel of the ground and leno threads in a region between the ground and leno threads.

2. Weaving machine in accordance with claim 1, with the integrated cleaning apparatus including at least one nozzle which is arranged so as to be movable in the longitudinal direction of a reed and/or at least one nozzle comprising a stationarily arranged slit nozzle with a horizontal slit arrangement.

3. Weaving machine in accordance with claim 1, with the deflection element being acted on by compressed air and including nozzles by means of which a substantially horizontal compressed air flow transverse to the direction of travel of the ground and leno threads is produced in the region between the ground and leno threads.

4. Weaving machine in accordance with claim 1, including a control system for activating the nozzles of the integrated cleaning apparatus periodically and/or cyclically and/or one after the other and/or when required.

5. Weaving machine for the manufacture of leno cloths comprising a reed and a leno apparatus with leno elements for the forming of a shed including guide elements and a deflection element for ground threads and leno thread guide elements for leno threads, and a cleaning apparatus integrated into the weaving machine for the removal of contaminations in a region of the leno apparatus including one or more nozzles, at least one of the nozzles being arranged in a lower region of the leno elements for directing a compressed air flow towards the leno elements.

6. Method for cleaning a weaving machine manufacturing leno cloths, the weaving machine including a leno apparatus with leno elements by means of which a shed is formed of ground threads and leno threads, the method comprising removing contaminations in a region of the leno apparatus and/or the shed with a cleaning apparatus which is integrated into the weaving machine and with a plurality of nozzles generating a substantially horizontal compressed air flow which is transverse to a direction of travel of the ground and leno threads in a region between the ground and leno threads.

7. Method in accordance with claim 6, including activating the integrated cleaning apparatus of the weaving machine with a control system in the weaving machine.

8. Method in accordance with claim 6, with the weaving machine being used in a weaving mill, said weaving mill being equipped with one or more travelling clearers, and with the integrated cleaning apparatus of the weaving machine being activated in accord with the travelling clearers, and/or with the contaminations which are forwarded out of the shed being removed through the travelling clearers.

9. Method in accordance with claim 6, including feeding compressed air to the nozzles at least one of periodically, cyclically, one after the other, and when required.

10. Method in accordance with claim 6, including blowing compressed air in at least one of a substantially vertical direction and a substantially horizontal direction and opposite to the direction of travel of the ground and leno threads.

* * * * *